United States Patent [19]

Lee et al.

[11] Patent Number: 4,599,091

[45] Date of Patent: Jul. 8, 1986

[54] BRIQUETTE FORMING APPARATUS

[76] Inventors: Andrew O. Lee, 7126 Newton Ave., Richfield, Minn. 55423; Heinz A. Muehlbauer, 2920 Kibler Ave.; Keith Blackburn, 1316 Florence St., both of Enumclaw, Wash. 98022

[21] Appl. No.: 650,431

[22] Filed: Sep. 14, 1984

[51] Int. Cl.[4] ..... B30B 11/00

[52] U.S. Cl. ..... 44/11; 100/299; 100/903; 425/107

[58] Field of Search ..... 44/11–13, 44/2; 100/299, 903; 425/107, 182

[56] References Cited

FOREIGN PATENT DOCUMENTS 1193776 6/1970 United Kingdom ..... 44/13

OTHER PUBLICATIONS

Glomera Briquetting Machine, Fred Hausmann, Ltd., Basel, Switzerland (1972).

*Primary Examiner*—Carl F. Dees

*Attorney, Agent, or Firm*—Orrin M. Haugen; Thomas J. Nikolai

[57] ABSTRACT

Flywheel driven, ram compressed briquette forming apparatus having a density determining split die and pneumatically actuable die clamp. The improvement comprises an improved ram housing having a plurality of access covers opening to the ram bearings, oil seals, scraper rings, split die and other wear susceptible components. Further features include provision for water cooling the die, maintaining a constant oil pressure at the bearings, separating the oil seals from primary and secondary segmented ram scraper rings, increasing the crosshead sliding surface area, to oil cooling the ram, and all of which taken together facilitate briquette production and prolong the maintenance cycle.

12 Claims, 10 Drawing Figures

Fig. 10
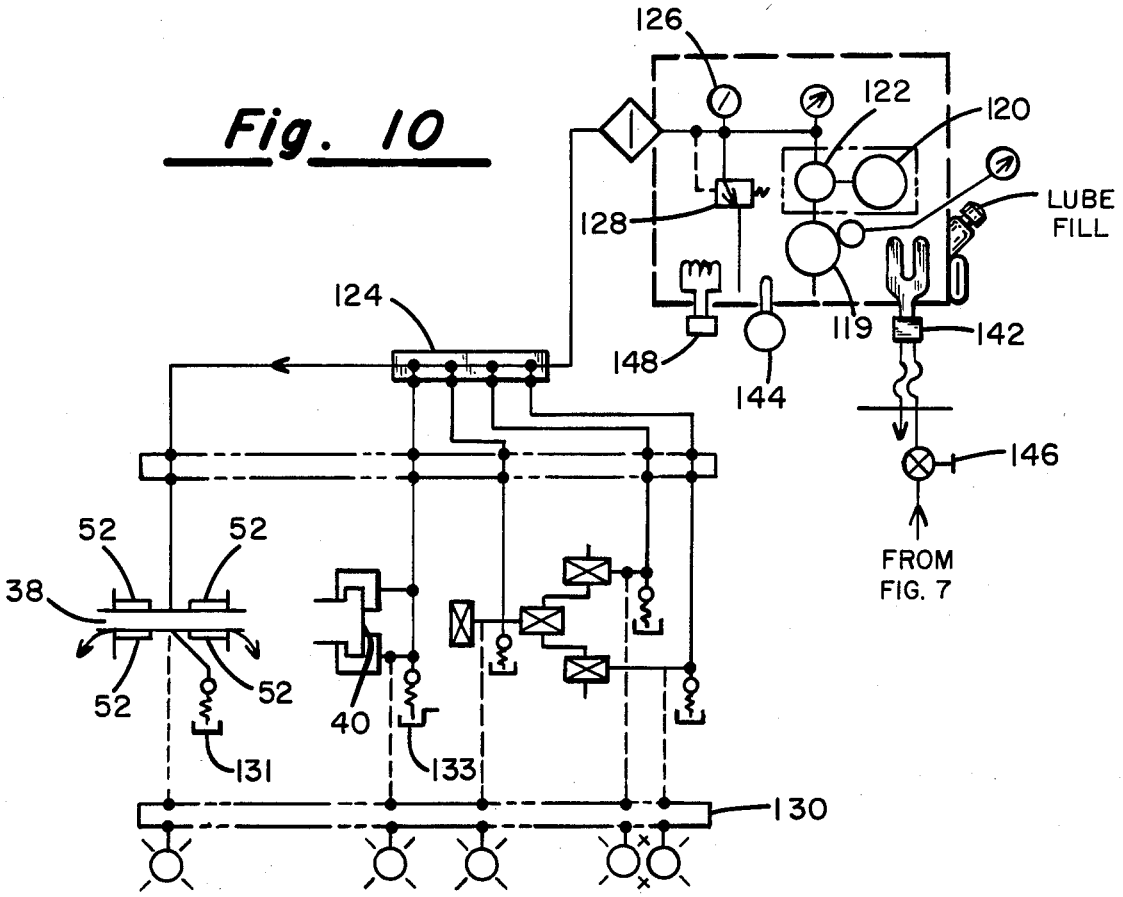
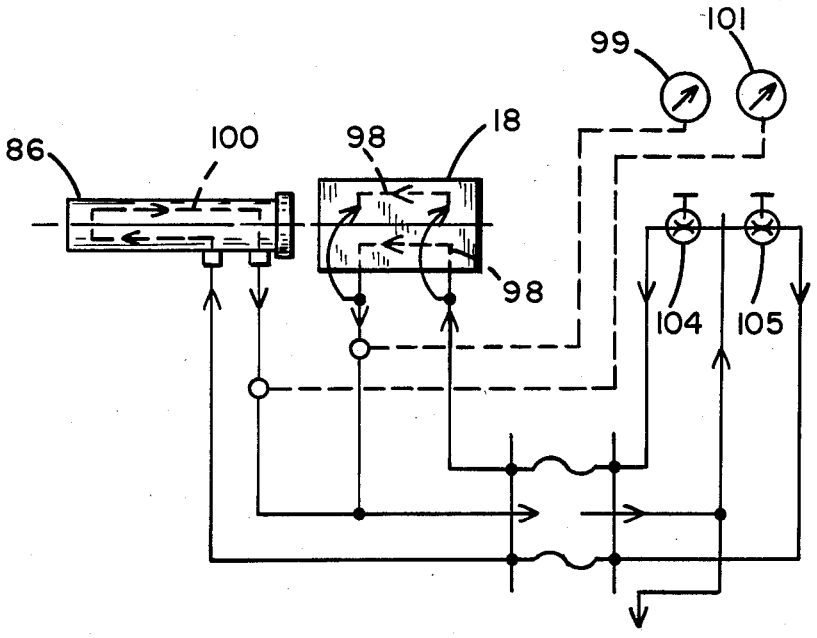
Fig. 7

BRIQUETTE FORMING APPARATUS

BACKGROUND OF THE INVENTION

I. Field of the Invention

The present invention relates to apparatus for forming briquettes from combustible raw materials and, in particular, to improved apparatus constructed to selectively expose portions of the ram slide path during maintenance and to prolong the time between maintenance. These ends are achieved through the redesign of various components and the inclusion of water and oil cooling of the ram slide path.

II. Discussion of the Prior Art

With the increasing cost of energy, efforts have been directed toward developing alternative energy sources and one such effort consists in the fabrication of burnable briquettes from waste combustible raw materials, such as sawdust, corn stalks, waste paper and other combustible "bio-mass", materials that are available in economical quantities. Because such materials are typically rather voluminous relative to their BTU content, it is necessary to reduce the raw material to a size that provides a relatively high BTU content per unit of volume and a form that is readily adaptable to burning. A particular form that has been found to be desirable is a puck-like briquette. Such briquettes may be stored and/or burned by themselves or in combination with various other fuels in conventional furnaces. Alternatively, it may be necessary to adapt an available furnace to be compatible therewith.

One type of commercially available equipment for forming such briquettes is a machine produced by the SPM Corporation. This equipment generally comprises apparatus having a power-driven flywheel that operates in conjunction with a crank shaft and connecting rod to transfer power, via a crosshead assembly, to a compression ram. Waste matter entering a compression chamber is thence caused to be compressibly rammed into an uncooled, split, forming die and wherefrom the compressed material exits via a clamped split-die assembly.

In using equipment of the above type, however, problems have arisen in that the available assemblies have not been designed from the standpoint of facilitating normal maintenance. It is principally in this regard, that the present invention has been developed as an improvement to ram driven briquette making apparatus. That is, the present invention facilitates normal maintenance via a plurality of housing covers and prolongs the time between maintenance by providing cooling at critical heat generating portions of the apparatus, by separating the ram scraper rings and oil seals and by attention to the manner in which the reciprocating ram is supported at the points of maximum load.

Problems have arisen in the aforementioned SPM machine in that normal wear items, such as ram oil seals, scraper rings and the split dies, and which are not readily accessible, due to machine designs that integrate the ram assemblies within closed housings. Thus, the mere inspection or changing of individual parts in that prior art system requires the disassembly of the entire ram assembly. Wear is further aggravated in the SPM machine because of metal-to-metal contact between the scraper rings and the ram which, even though they are of dissimilar metals, causes grooves to form in the ram. This allows biomass material to enter the oil system and/or oil is permitted to leak into the compression chamber. Because the prior art apparatus is dependent upon an oil injection system for delivering a specified volume of oil to the wear points, lubrication is hampered by the accumulation of dirt and debris in the oil sump which tends to plug the injectors and/or cause leakage at the seals. The prior art apparatus as represented by the SPM machine also employs a crosshead assembly that has a relatively small wedge shaped horizontal slide area which is suspectible to wear as the ram is driven horizontally to and fro. Still further, essentially no cooling of the ram has been provided in that prior art design. This adversely affects the life of these components due to the high heat produced through the compression process. The raw material feeder assembly of the prior art machine also has proven to be subject to frequent jamming wherein the ram may be caused to seize-up. These seizures are not easily cleared without the tedious and time-consuming dismantling of the apparatus.

To overcome these problems, the present improved apparatus was conceived. It generally provides an improved briquette forming apparatus which overcomes the foregoing problems, facilitates maintenance and reduces down-time. Specifically, the present invention provides for a multi-segmented housing that surrounds the ram slide assembly and permits the exposure and periodic maintenance of the various critical wear elements integral to the ram. That is, split housing covers are provided in the regions of the split die, oil seals, ram bearings and scraper rings which are the parts most subject to wear and maintenance. Further, the ram scraper rings have been segmented to provide primary and secondary scraping regions. By employing scrapers of dissimilar metals, ram wear is decreased and longer seal life results. Also, the accumulation of dirt within the sump is avoided. The housing cover in the region of the split die has also been designed to be liquid cooled, while the ram guide housing has been modified to provide oil cooling. Appurtenant temperature sensors and control apparatus monitor and control the temperature thereof. A self-clearing prefeeder assembly is also provided with a controllably reversing auger, whereby auger direction is reversed upon the detection of jams and resumed after a delayed period.

SUMMARY OF THE INVENTION

The present invention comprises an improved briquette forming apparatus having a flywheel-driven ram slide assembly for compressively forming briquettes from combustible raw materials by compressing the raw material through a clamped, liquid-cooled, split, tapered die assembly. The improvement resides in the design of the ram slide housing assembly which provides for a plurality of housing covers extending over selected portions of the assembly. Periodic maintenance of the oil seals, scraper rings, ram bearings and split die is thereby facilitated. Die cooling and ram cooling are also separately achieved via respective water cooling and oil cooling systems.

Further improvements comprise the segmentation of the scraper rings into primary and secondary regions and the separation thereof from the oil seals, along with the inclusion of a constant pressure lubrication system such that lubricant is provided at constant pressure to critical wear points at the ram, crosshead assembly and crankshaft bearings. Additionally, provisions are made for self-clearing the pre-feeder assembly during jam conditions by controllably reversing the pre-feeder upon detecting a jam and then resuming operation after a predetermined delay.

The above objects, advantages, distinctions and construction of the present invention as well as various others will become more apparent upon reference to the following detailed description of a preferred embodiment illustrated in the appended drawings in which like numerals in the several views refer to corresponding parts.

BRIEF DESCRIPTION OF THE DRAWINGS

FIG. 7 shows a schematic diagram of the die cooling system.

FIG. 10 shows a schematic diagram of the lubrication system.

DESCRIPTION OF THE PREFERRED EMBODIMENT

Figure 1:
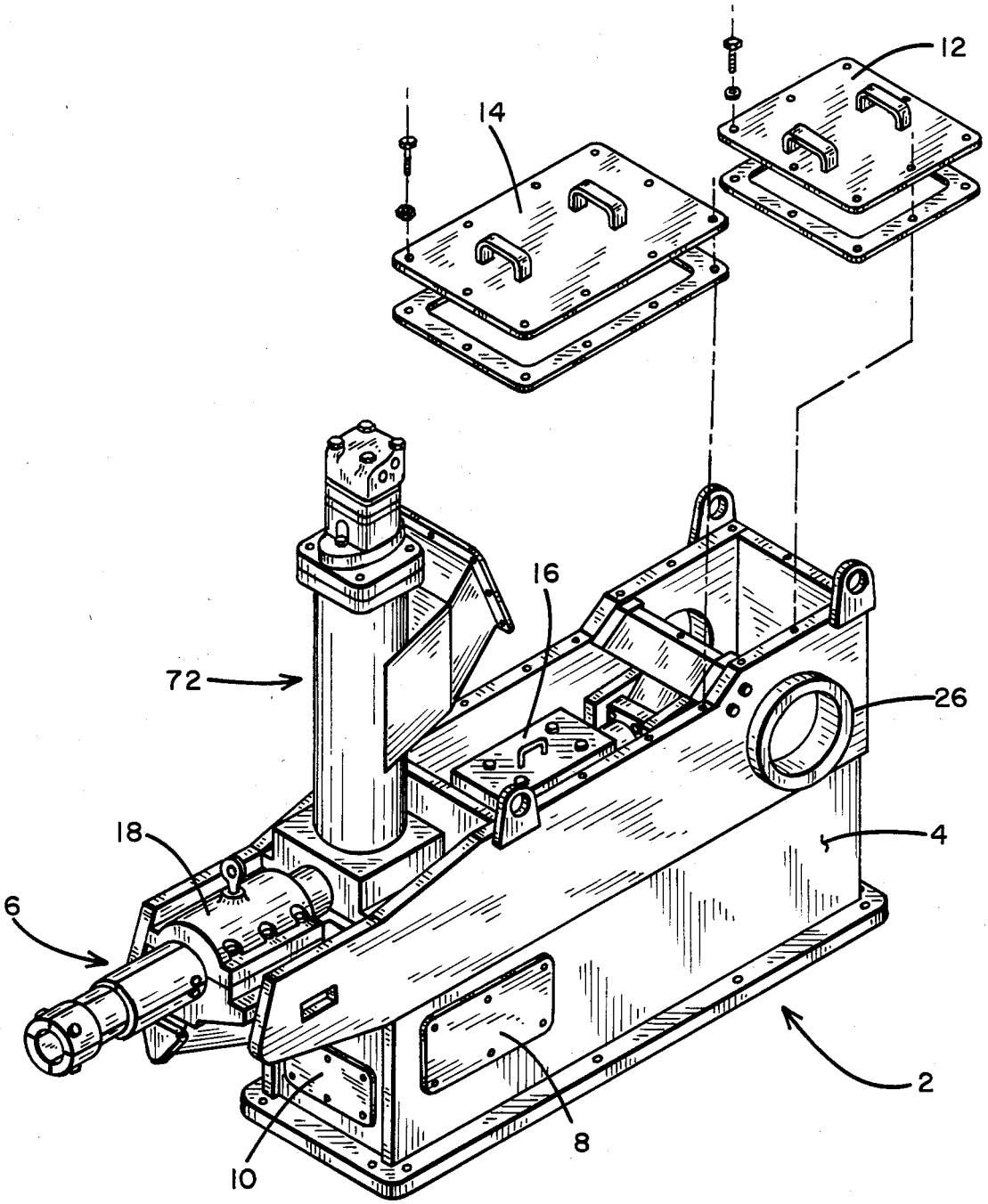
FIG. 1 shows a partial perspective view of the housing of the briquette forming apparatus, less the pre-feeder assembly.

Directing attention to FIG. 1, a perspective assembly view is shown of the cast metal base housing 2 of the briquette making apparatus of the present invention. The base housing 2 is generally comprised of a lower lying oil sump portion 4 and an overlying ram slide portion 6. Associated with the ram slide portion 6, but not shown, are right and left flywheels, along with an adjoining crankshaft assembly and which together provide motive power via an associated 100 horsepower motor and intermediate speed reduction transmission. Vertically rising from the ram slide portion 6 is the pre-feeder assembly 72, which supplies raw material to the ram slide 6. The pre-feeder assembly 72 will be described in greater detail heeinafter with respect to FIG. 5.

Mounted about the base housing 2 are a plurality of gasketed access covers, two of which covers 8 and 10 permit access to the oil sump 4. A pair of other covers 12 and 14 permit respective access to the crankshaft assembly (not shown) and the ram slide assembly. Mounted beneath gasketed cover 14 is a ram slide housing cover 16 that, upon removal, provides direct access to the ram slide bearings, oil seals and scraper rings (not shown). Mounted just forward of the housing cover 16 and away from the sump 4 is a second cast, split, housing cover 18 that overlies the split die and permits access thereto during normal maintenance and/or during the clearing of jam conditions.

As mentioned previously with respect to available prior art equipment, these covers 14 and 16 provide unique advantages thereover during normal maintenance. Because the previous equipment has been formed as an integral assembly, access may only be had to the ram bearings, oil seals, scraper rings, split die, ram and other parts by removing the split die clamp (not shown) and the split die housing from the front of the SPM base assembly before removing the entire ram assembly, and then only after releasing the ram from the crosshead assembly at the rear of the base housing. In short, simple inspection and/or normal maintenance of the prior art equipment requires an excessive amount of time and a major dismantling of the apparatus. The advantageous construction of the present invention, on the other hand, provides more readily obtained and specific access to the wear areas of the ram slide portion 6, without having to dismantle the entire apparatus. If not already apparent, these advantages will be discussed in greater detail hereinafter with respect to the remaining drawings.

Figure 2:
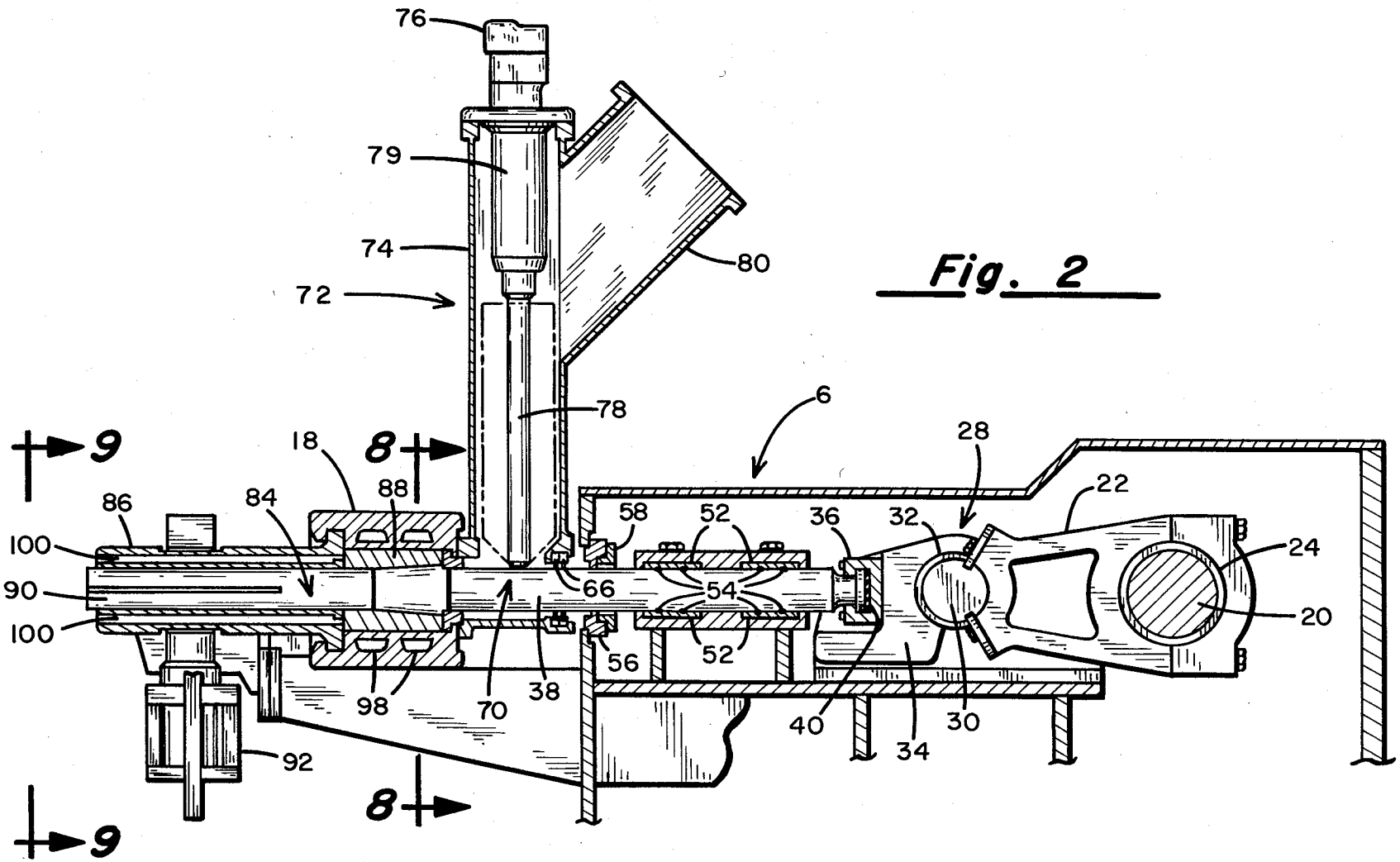
FIG. 2 shows a partially sectioned, cross-sectional view taken along section lines 2—2 of FIG. 1.

Referring, therefore, to FIG. 2, a partially sectioned, cross-sectional view taken along section lines 2—2 of FIG. 1 is shown. This view shows in greater detail the ram slide housing portion 6 and its internal assembly. Because the oil sump portion 4 principally contains the lubricating oil, oil cooler, oil heater, oil pump and filter, it will not be discussed in detail, until the lubrication system is discussed with respect to FIG. 10. Instead, FIG. 2 will be referred to in describing the ram slide housing portion 6 and its internal assembly. It is this structure which is constrained to act in a horizontal reciprocating fashion to compress the raw material as it passes from the compression chamber through the split die assembly. The crankshaft 20 is shown relative to its connecting rod 22 and sleeve bearing 24. As mentioned, the crankshaft 20 is coupled to a pair of right and left flywheels of large diameter and mass (not shown) that are powered by an appropriately sized engine and transmission. The crankshaft 20 is supported at the sidewalls of the base housing 2 by respective conventionally lubricated bearing assemblies 26 (FIG. 1) and, thus, the crankshaft 20 rotates freely with the connecting rod 22 rotating in an eccentric fashion within the base housing 2.

The rotary, eccentric rotation of the crankshaft 20 is coupled by the connecting rod 22 to the crosshead assembly 28, where it is converted to a transverse horizontal movement. Specifically, each end of the connecting rod 22 is split and coupled by bolts at one end about the main bearing 24 at the crankshaft 20 and at the other end about a crosshead pin 30 that is contained within a sleeve bearing 32 at the crosshead assembly. Coupled, in turn, to the opposite side of the crosshead 34 is a split collar 36 that receives and retains one end of the ram 38. Mounted in between the collar 36 and the end of the ram slide 38 then is a ram pressure pad 40. At this point, it should be noted that a slight tolerance mismatch of approximately 0.002 inches is allowed within the crosshead 34 in the region between the end of the ram slide 38 and pressure pad 40. This space ensures that the ram 38 stays centered relative to the crosshead 34, during the adjustment of the crosshead 34. Also, oil is circulated within this space during ram motion.

Figure 3:
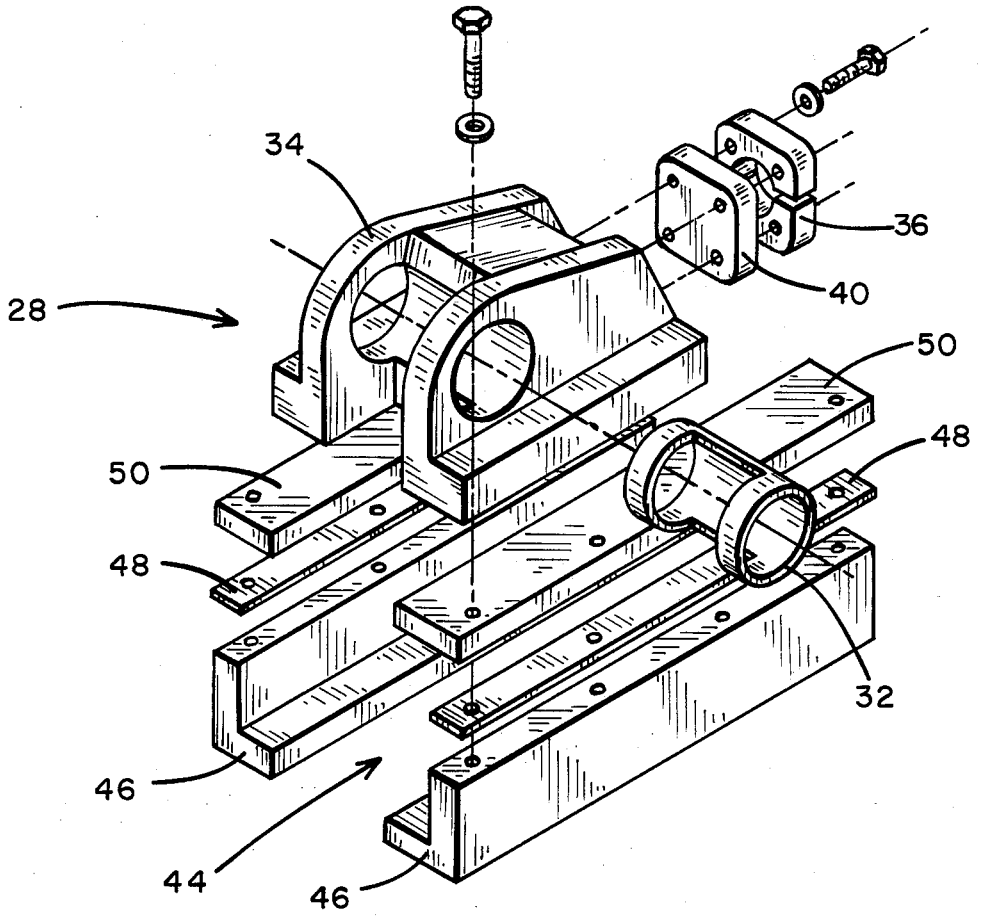
FIG. 3 shows a perspective assembly view of the crosshead assembly.

In the above regard, attention is also directed to FIG. 3 which illustrates a more detailed perspective assembly view of the crosshead assembly 28. In addition to the structure of the crosshead 34, a better view is shown of the slideway assembly 44 which comprises a pair of right angled slideway members 46 that are boltably secured to the base housing 2 by bolts and above the right and left sides of the members 46 individual keepers 48 and shims 50 are mounted. The crosshead 34 is thus slidably contained beneath and between the shims 50 and upon the slideway members 46 so as to move to and fro with the reciprocating motion of the connected rod 22. During setup and thereafter, the thickness and width of the shims 50 may be adjusted as necessary to center the crosshead 34 to the ram 38.

At this point, it is to be noted that a further advantage of the present equipment over previously available equipment is obtained by the use of a rectangular slideway 44 in lieu of a wedge-shaped slideway. In particular, a rectangular slideway provides, greater supporting surface area over which the vertical forces imparted to the crosshead 34 from the connecting rod 22 are displaced. Also, the shims 50 permit the adjustment of the crosshead 34 relative to any induced sideways movement.

Continuing on with the description of the ram slide housing portion 6 referring again to FIG. 2, the ram 38 is contained beneath the bolted ram housing cover 16 is supported between a pair bronze sleeve bearings 52, and each of which has a spiral lubricant receiving groove 54 formed therein. A hollowed region is also provided between the bearings 52 such that as oil is injected between the bearings 52 and over the ram 38, it is caused to follow the spiral grooves 54 to individual oil return ports (not shown) opposite the ends of the bearings 52 within the hollowed region and back to the oil sump 2. Thus, the ram slide 38 is continuously bathed in oil. This acts not only to lubricate the ram 38, but also to provide an oil bath for cooling the ram 38. Also, because of the present invention's inclusion of the ram housing cover 16, an operator is now able to more easily obtain access to the sleeve bearings 52 and ram 38 for inspection and/or replacement. Due also to the radial float built into the ram/ram slide connection, the crosshead 34 may be adjusted for wear without affecting the alignment of ram 38. This is in contrast to the prior art SPM equipment which has the ram 38 rigidly mounted to the crosshead 34. This oftentimes results in ram misalignment due to crosshead wear.

Figure 4:
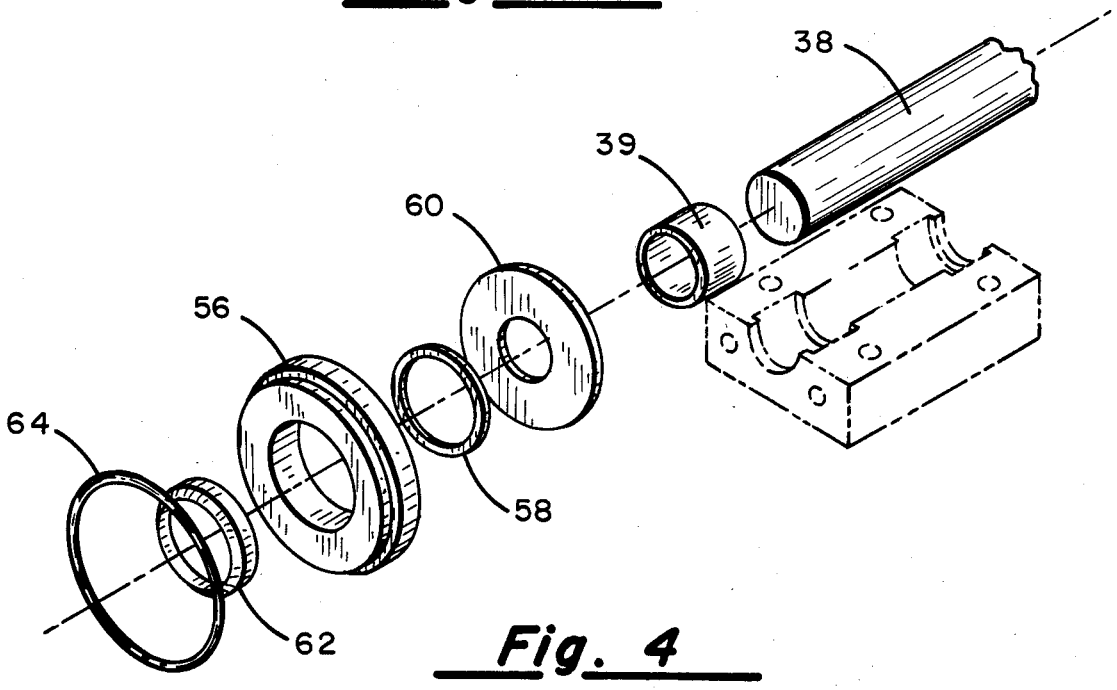
FIG. 4 shows a perspective assembly view of the ram slide assembly.

Mounted beneath the forward end of the ram housing cover 16 is a circular, cup-shaped ram oil-sealing housing 56. It is mounted within the base housing 2 via a pair of jack screws (not shown) and contains a circular oil seal 58 that mounts between the front of the seal housing 56 and a backing plate 60 (FIG. 4). The oil seal 58 thus surrounds the ram 38 and acts to wipe oil from the ram 38 as it slides to and fro. The removed oil then falls to the bottom of the sump housing 2, where it collects and is again filtered and pumped to the wear regions. FIG. 4 also shows a perspective assembly view of the ram 38 relative to the oil seal housing 56, seal 58 and backing plate 60.

FIG. 4 also shows a secondary scraper ring 62 mounted within the bore of the oil seal housing 56 in front of the oil seal 58. Like the oil seal 58, the scraper ring 62 surrounds the ram, but it contains a convex leading edge, such that with each return stroke, it scrapes any foreign matter adhering to the ram 38 therefrom and prevents it from entering the oil sump housing 2. Finally, an "O" ring 64 seals the oil seal housing 56 against leakage and separates the lubricant in the sump portion 4 from the compaction chamber.

Figure 5:
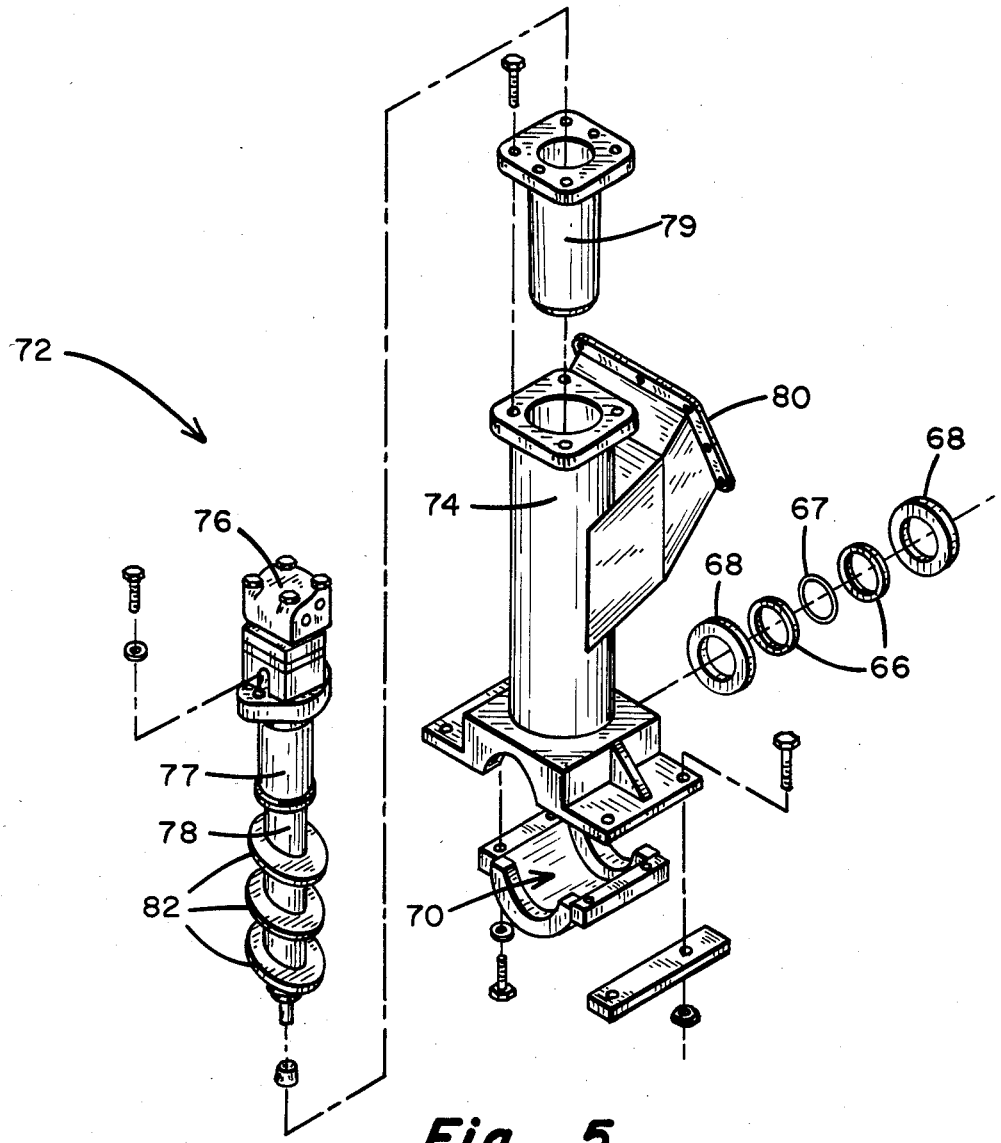
FIG. 5 shows a perspective assembly view of the pre-feeder assembly.

With reference to FIGS. 2 and 5 it can be seen that mounted forward of the secondary oil scraper ring 62 is a pair of primary oil scraper rings 66 each of which is mounted in spaced apart axial relation to one another between individual keeper housing rings 68. The primary scraper rings 66, like the secondary scraper rings 62, each have a beveled leading edge and are mounted about the ram 38 such that any raw materials adhering to the ram 38 are scrapped therefrom during the return stroke. However, now because of the segmentation and separation of the rings 66 and 62, any residual raw material that is missed by the primary scraper rings 66, is typically caught and removed by the secondary scraper rings 62. Thus, because of this displacement, the life of the oil seal 58 is prolonged and the problem of the build-up of foreign matter in the lubricating system is reduced. Also, the loss of lubricant to the compaction chamber and the attendant soaking of the raw material is minimized, since the backsides of the scraper rings 66 and 62 also tend to prevent the oil from entering the compaction chamber.

Positioned immediately forward of the primary scraper rings 66 is the compaction chamber 70 and which for the presently preferred embodiment is configured as a cylindrical chamber. Because only a minimal amount of clearance or dead space is provided between the overlying auger-containing pre-feeder assembly 72 and the lower lying cast portion of the base housing 2, a minimal amount of raw materials is permitted to collect within this deadspace. This minimizes the probability of jams that might otherwise be induced. The length of the compaction chamber 70 is sized to accomodate the ram stroke and which for the illustrative embodiment is approximately eight inches long. As should be apparent to those of skill in the art, stroke lenth may be varied as necessary, depending upon the types of raw material to be compacted and the desired briquette density as well as other variables.

Referring now to the pre-feeder assembly 72, it is removably mounted above the compaction chamber 70 and essentially comprises a hydraulically driven auger assembly that, upon being gravity fed with combustible raw materials, conveys the materials to the compaction chamber 70. It is comprised of a vertical housing 74 and attached to the upper end there is a reversible hydraulic motor 76. The motor 76, in turn, drives a centered auger blade-containing spindle 78 via an associated interconnecting bearing assembly 77 that is contained within a bearing housing 79. Raw material is admitted to the enclosure 74 via a side-mounted chute assembly 80 where it is received by the auger blades 82 and controllably supplied to the compaction chamber 70. Depending upon the type of raw material and/or feed desired, the auger blades 82 may be configured in a screw-like fashion or as separate angulated baffels mounted to the spindle 78.

Directing attention also to FIG. 5, a more detailed perspective assembly view is shown of the pre-feeder assembly 72, along with the primary scraper rings 66. From FIG. 5, it is to be noted that upon removing the pre-feeder assembly 72 from the ram slide portion 6 of the base assembly 2, the compaction chamber 70 and primary scraper rings 66 are fully exposed in much the same fashion that the removal of the ram housing cover 16 exposes the ram 38 and ram bearings 52. Thus, should jams occur and/or should it be necessary to dismantle the pre-feeder assembly 72, it may easily be disassembled from the base housing 2. Also, should the primary scraper rings 66 need to be inspected and/or replaced, this can be accomplished by removing them from their keeper housings 68 and the spacer 67.

Returning attention again to FIG. 2, mounted forward of the compaction chamber 70 and pre-feeder assembly 72 is a split die 84 and its associated split die housing 86. For the presently preferred embodiment, the split die 84 essentially comprises a tubular member having a receiver section 88 with an inwardly tapered bore where the raw materials are first received from the compaction chamber 70. Upon leaving the receiver section 88, the partially compacted materials are forced into an elongated split snout portion 90, the inside diameter of which is controlled by a pneumatic clamp assembly 92 that mounts about the split die housing 86. Specifically, the snout portion 90 contains four individual elongated segments, each of which are compressively clamped by the clamp assembly 92 so as to determine the final outer diameter and density of the produced briquettes.

For the present embodiment, the briquettes are produced with a hockey puck-like shape and are formed by slicing segments from the tubularly compressed raw material as it leaves the end of the snout 90. To control the compaction density either the taper of the receiver section 88 and/or the amount of clamping pressure at the clamping assembly 92 may be varied since either of these changes varies the inside diameter of the material flow path and causes a change in amount of compaction that occurs as the material traverses the split die 84. Considering the BTU content of the raw material, the compaction density may be varied for dissimilar materials so as to produce briquettes with similar BTU contents.

Mounted adjacent to and forward of the pre-feeder assembly 72 is the housing cover 18 which secures the housing 86 to the ram slide portion 6 of the base housing 2. Assuming that the die clamp assembly 92 has been released, and the split-die housing cover 18 has been removed, the operator gains access to the slit-die 84 for inspection and replacement.

Figure 6:
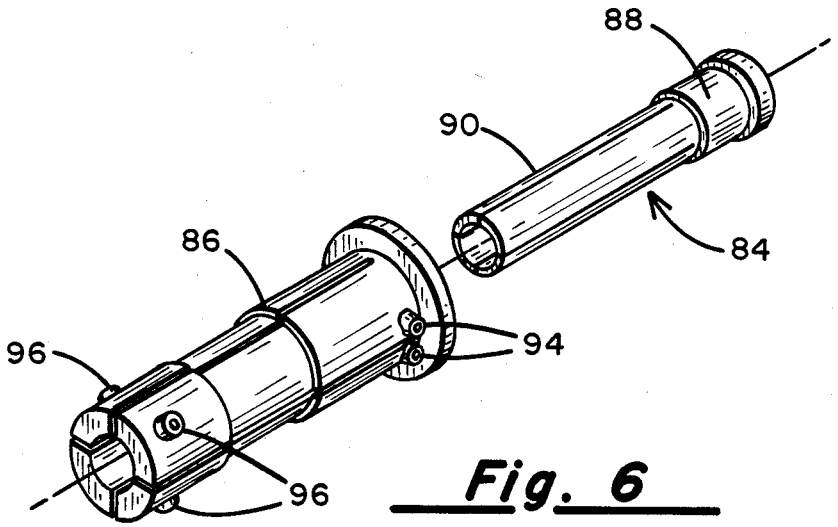
FIG. 6 shows a perspective assembly view of the split die.

In particular and referring to the perspective assembly view of the split die 84 and split die housing 86 in FIG. 6, it may be noted that the split die 84 may be removed from the split die housing 86, after releasing a pair of set screws (not shown) that mount within the protrusions 94 on the split die housing 86. The split die housing 86, like the snout portion 90, contains a plurality of lengthwise slits that segment the die housing 86 into the same number of segments as the snout portion 90. A longitudinal central recessed region of smaller surface diameter is also provided in the split die housing 86 for receiving the clamp assembly 92. Individual tapped protrusions 96 at the forward end of the split die housing 86, in turn, permit the adjustment of individual set screws mounted therein. Specifically, upon mounting the split die 84 within the split die housing 86 and positioning the housing within the clamping assembly 92, hydraulic pressure is exerted on each of the segments so as to controllably reduce the diameter of the extruded materials from that of the receiver section 88 to some smaller diameter. If during operation further adjustment is still required, this may selectively be applied by adjusting the set screws (not shown) within the protrusions 96.

Redirecting attention to FIG. 2 and to the split die housing cover 18, it is to be noted that it contains a plurality of cooling channels 98 that circumscribe the receiving section 88 of the split die 84. Because a substantial portion of the material compression occurs in this region, the greatest amount of heat is produced here, hence the need for cooling whereby heat may be substantially removed by the circulation of a cooling fluid through the cooling channels 98.

Figure 8:
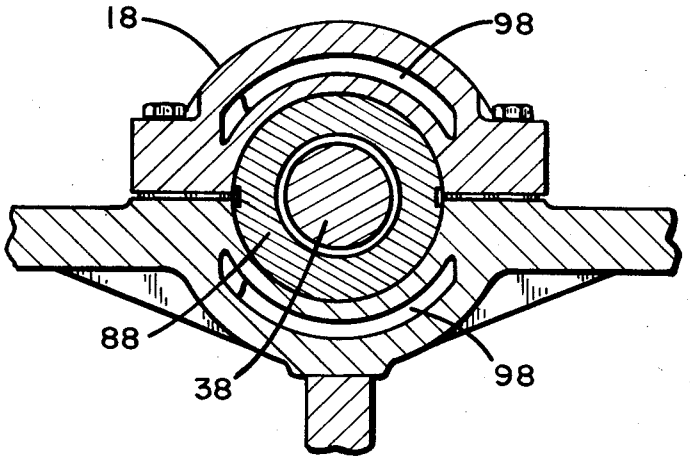
FIG. 8 shows a cross-sectional view taken along section lines 8—8 of FIG. 2 of the split die housing.

FIGS. 7 and 8 show the die cooling system. In particular, FIG. 8 illustrates that cooling channels 98 form in the respective housing cover 18 and lower lying portion of the ram slide portion 6. The channels 98 of each half are essentially isolated from the other half. Thus, upon removing the upper cover 18, one does not have to be concerned with water spillage, other than for the connection of the water supply to the coupler (not shown) at the collar half 18.

The schematic of FIG. 7 also shows that circulating water is supplied to the split die housing 86. This is desirable since additional heat is generated as the raw material is compressed further in snout portion 90. Specifically, individual lengthwise cooling channels 100 in each of the segments of the split die housing 86 circulate fluid therethrough and cool the snout portion 90 of the split die 84. By also coupling individual temperature sensors 99 and 101 in circuit with the water channels 98 and 100, an operator is able to monitor the temperature of the fluid and thereby the heat produced from compaction. In response thereto, either of the gate valves 104 or 105 can be opened or closed to permit greater or lesser fluid circulation to the area(s) of concern. Finally, it is to be noted from FIG. 7 that fluid cooling is also provided to the lubricant within the sump housing 2. This feature will be discussed hereinafter with respect to FIG. 10.

Figure 9:
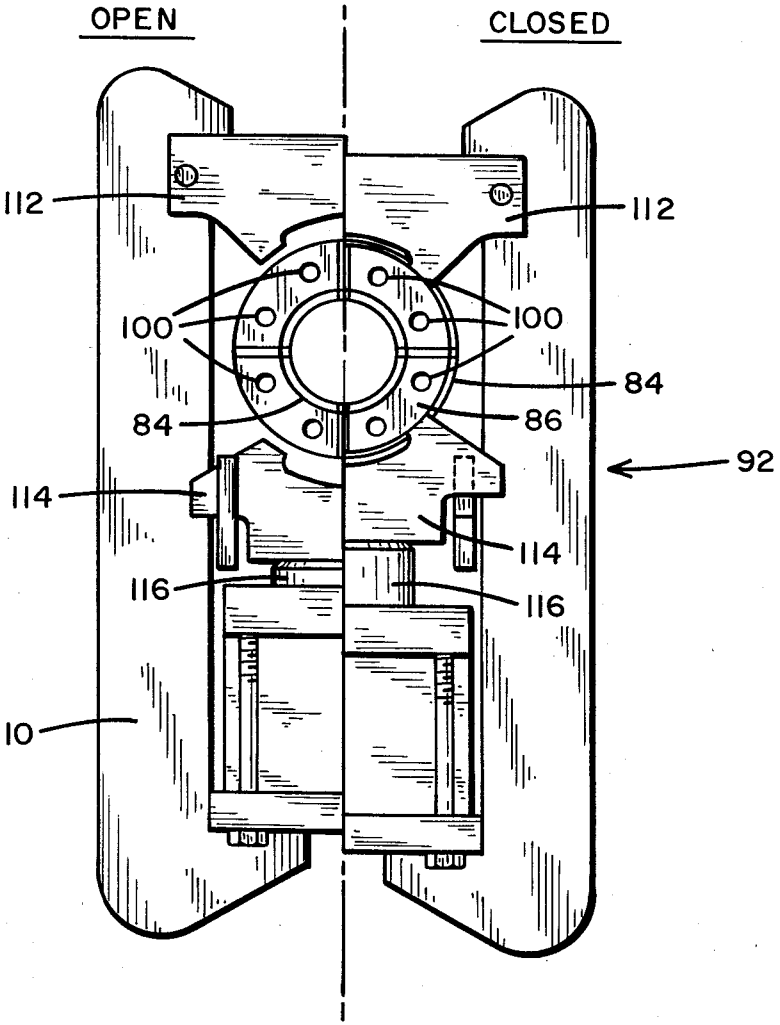
FIG. 9 taken along section lines 9—9 of FIG. 2, shows a partially sectioned end view of the split die clamp assembly in its open and closed positions.

Before referring to the lubricating system, though, attention is next directed to FIG. 9 which depicts a partially sectioned cross-sectional view taken along section lines 9—9 of FIG. 2 and showing the die clamping assembly 92 in its open and closed conditions. Specifically, the open condition is shown to the left of the vertical center line and the closed condition is shown to the right of the center line. Essentially, the clamping assembly 92 is comprised of a yoke-shaped frame weldment 110 that contains a pair of upper and lower jaws 112 and 114, each jaw having a pair of contact points for compressively contacting the mating segments of the split die housing 86 and split die 84. A hydraulically actuated piston assembly 116 mounted beneath the lower jaw 114 controllably opens or closes the jaws 112 and 114 and causes the previously mentioned adjustment of the split die diameter. The configuration of the cooling channels 100 within each segment of the split die housing 86 which allows fluid to flow through each of the individual segments can be seen in FIG. 9.

Turning attention now to FIG. 10, a schematic diagram is shown of the lubrication system used with the present apparatus. Recalling that prior art briquette making apparatus employed constant volume oil injection, in contrast, the present invention employs a constant pressure system with a suitable volume capacity to accomodate most typically encountered oil leakage conditions, while still maintaining a constant pressure to the leaking wear point. While the prior art systems have demonstrated a tendency to plug up to the point where one cannot be assured that a proper volume of lubricant is being distributed, to avoid possible insufficient lubrication to one of the wear points, the present system incorporates a constant pressure lubrication system whereby, independent of the amount of leakage, a sufficient volume of lubricant, at constant pressure, is provided to each wear point to prevent against burn out that might otherwise occur. Because these wear points are all contained within the base housing 2, any oil which leaks therefrom in the present system is returned to the oil sump 4 and recirculated after being filtered.

As shown in FIG. 10, the present lubrication system includes an electrically actuated starter 119 and hydraulic pump 120 that pumps the oil through a suitable filter 122 into the primary distribution manifold 124. A pressure sensor 126 and a pressure relief valve 128 are included to monitor the oil pressure. The pressure sensor 126 is set at a pressure approximately 150 psi less than that of the relief valve 128 and acts to monitor the oil flow from the filter 122 and produce an alarm condition at a console panel 130, if the pressure rises to the threshold of the sensor 126, such as might occur with a plugged filter 122. If the pressure continues to rise, the pressure relief valve 128 opens and returns the oil to the sump 2 and/or provides further warning to the operator and/or to shutdown the system.

Generally, though, the oil is provided at approximately 100 psi to the manifold 124 and wherefrom it is distributed, via individual conduits, to various system wear points. One wear region is the location beneath the ram housing cover 16, where the lubricant is supplied in the space between the ram bearings 52 and thence via the spiral grooves 54 back to the sump 2. Also, it is circulated about the end of the ram 38 in the region of the pressure pad 40 and again returned to the sump 2. Individual 100 psi pressure sensors 131, 133, in turn, sense the oil pressure in these regions and advise the operator by lighting an appropriate pilot light at the console 130, if the pressure should fall. Additionally, oil is supplied by the oil conduits to the bearings associated with the connecting rod 22 at the crosshead pin 30 and crankshaft 20 and at the bearing housings 26 adjacent to the flywheels. Similarly, individually associated pressure sensors at these bearings monitor the oil pressure and provide an indication if it should fall below the set-point of the sensor.

Water cooling is also provided for the oil in the sump housing 2 via the heat exchanger 142 (FIG. 10) and through which cooling fluid is approriately circulated once a predetermined temperature (typically 50 degrees Fahrenheit) is sensed at the sump oil temperature sensor 144. Also, a shut off valve 146 is provided to permit the isolation of the heat exchanger 142 from the fluid cooling system. In passing, it should also be noted that for start-up conditions and temperatures below 40 degrees Fahrenheit, a heater 148 may be provided in the sump 2 to permit heating of the oil before beginning operation. Thus, upon heating the oil to approximately 40 degrees Farenheit, the starter 119 is enabled and thereby the pump 120 and remainder of the apparatus.

While the present invention has been described with respect to its presently preferred embodiment, it is to be recognized that various modifications may be made thereto without departing from the spirit and scope thereof. For instance, it is contemplated that a multinozzle version might be configured about a crankshaft having more than one eccentric and wherein a number of the foregoing improved RAM slide assemblies would produce briquettes. Generally, too, the intent of the present invention is to provide briquette forming equipment having a ram slide path that is more easily accessed to permit periodic inspection and maintenance, without having to engage in a complete or substantial disassembly of the apparatus. This is achieved via a ram slide path having a plurality of top mounted access covers in the regions of the wear points. Accordingly, it contemplated that the following claims shall be interpreted to include all those equivalent embodiments within the spirit and scope thereof.

What is claimed is:

1. Briquette forming apparatus comprising:

an enclosed housing having a sump portion containing a lubricant and at least one overlying multi-segmented ram slide portion having a lengthwise bore;

an elongated ram slidably mounted within the bore of said ram slide portion for reciprocating movement therein;

means coupled to said ram for providing reciprocating motive power thereto;

means for controllably supplying combustible raw materials to a compaction chamber displaced along the bore of said ram slide portion;

die means receiving said raw materials from said compaction chamber and having a tapered bore of larger diameter at the end adjacent to said compaction chamber than at an output end for compressively extruding said raw material into a predetermined shape, upon exiting said output end, in response to the reciprocating movement of said ram; and a plurality of detachable housing covers overlying said ram slide portion and forming a part of said lenthwise bore and said compaction chamber, each of said housing covers being individually detachable from said ram slide portion for permitting access to regions subject to wear located along said ram slide portion, thereby facilitating the maintenance of said apparatus.

2. Apparatus as set forth in claim 1, including first and second sleeve bearings mounted beneath a first of said plurality of housing covers in concentric relation to said ram, each of said sleeve bearings having a lengthwise bore including a spiral groove for directing lubricant from a region between said first and second sleeve bearings to the opposite ends of said first and second sleeve bearings, thereby lubricating and cooling said ram during its reciprocatory motion.

3. Apparatus as set forth in claim 2, including:

oil seal means mounted in said ram slide portion forward of said first and second sleeve bearings in concentric relation to said ram for wiping oil from said ram during its reciprocatory motion and thereby preventing said lubricant from entering said compaction chamber; and first and second means axially displaced along said ram slide portion in concentric relation to said ram between said oil seal means and said compaction chamber for scraping raw material during each return stroke of said ram so as to prevent said raw material from entering said sump portion of said housing.

4. Apparatus as set forth in claim 1 wherein sid means for controllably suppying combustible raw materials comprises:

an elongated tubular housing detachably mountable to said compaction chamber, said tubular housing having an opening whereat said combustible raw material is received; and a motor-driven spindle centrally disposed within said tubular housing, said spindle having a plurality of auger plates mounted therealong for receiving and conveying said raw material to said compaction chamber.

5. Apparatus as set forth in claim 4, including means sensing the pressure on said raw material in the region of said compaction chamber for controllably reversing the direction of rotation of said spindle upon detecting a first predetermined pressure and for resuming the forward rotation of said spindle after a predetermined delay period, thereby self-clearing jams from said compaction chamber.

6. Apparatus as set forth in claim 1, wherein a first of said plurality of housing covers overlies a portion of said die means, said first housing cover having a plurality of hollow coolant circulating channels contained therein the dissipating heat generated during the compacting of said raw material.

7. Apparatus as set forth in claim 6 also including coolant channels in said ram slide portion disposed beneath said first housing cover and wherein said coolant channels within said first housing cover and the underlying portion of said ram slide are separate of one another.

8. Apparatus as set forth in claim 1, wherein said die means includes an elongated die housing having a plurality of lengthwise slits and a central bore within which an elongated, slit tubular die having a tapered bore is mountable and also includes means for indiivdually compressing the slit segments of said die and die housing to vary the diameter of said bore, said die housing further including coolant circulating channels within each of said segments for removing heat generated within said die during the compaction of said raw material.

9. Apparatus as set forth in claim 1, and further including means for providing said lubricant to wear points at a constant pressure.

10. Apparatus as set forth in claim 8, including means disposed in said sump housing for cooling said lubricant.

11. Apparatus as set forth in claim 1 and further including a rectangular crosshead slide assembly coupling said ram to a flywheel driven crankshaft assembly, said crosshead slide assembly including a pair of elongated right angled slidway members, a plurality of shims and a pair of keeper members for adjustably mounting said crosshead slide assembly relative to said ram and said slide portion.

12. Apparatus as set forth in claim 11 wherein said crosshead slide assembly includes a hollow pressure pad receiving region at the end of said ram and relative to which said ram is resiliently mounted and whereat lubricant may be received.

* * * * *

UNITED STATES PATENT AND TRADEMARK OFFICE

CERTIFICATE OF CORRECTION

PATENT NO. : 4,599,091

DATED : July 8, 1986

INVENTOR(S) : Andrew O. Lee et al

It is certified that error appears in the above-identified patent and that said Letters Patent are hereby corrected as shown below:

Column 10, Line 57, "sid" should read -- said --.

Column 11, Line 13, "the" (first occurrence) should read -- for --.

Column 11, Line 25, "indiivdually" should read -- individually --.

Signed and Sealed this

Twenty-first Day of October, 1986

[SEAL]

*Attest:*

DONALD J. QUIGG

*Attesting Officer*

*Commissioner of Patents and Trademarks*